US007836642B2

(12) United States Patent
Lin

(10) Patent No.: US 7,836,642 B2
(45) Date of Patent: Nov. 23, 2010

(54) ROOF EDGE WINDSCREEN

(75) Inventor: Jason JianXiong Lin, Cary, NC (US)

(73) Assignee: Renscience IP Holdings Inc., Raleigh, NC (US)

( * ) Notice: Subject to any disclaimer, the term of this patent is extended or adjusted under 35 U.S.C. 154(b) by 636 days.

(21) Appl. No.: 11/187,100

(22) Filed: Jul. 23, 2005

(65) Prior Publication Data

US 2006/0016130 A1 Jan. 26, 2006

Related U.S. Application Data

(60) Provisional application No. 60/591,164, filed on Jul. 26, 2004.

(51) Int. Cl.
*E04D 13/00* (2006.01)

(52) U.S. Cl. ..... 52/97; 52/94; 52/62; 52/84

(58) Field of Classification Search ..... 52/58, 52/62, 94, 97, 84
See application file for complete search history.

(56) References Cited

U.S. PATENT DOCUMENTS

| | | | | |
|---|---|---|---|---|
| 417,270 | A | 12/1889 | Nelson | |
| 1,878,126 | A | 9/1932 | Gates | |
| 2,021,929 | A | 11/1935 | Voigt | |
| 2,206,040 | A | 7/1940 | Ludington | |
| 2,270,537 | A * | 1/1942 | Ludington | 52/173.1 |
| 2,270,538 | A * | 1/1942 | Ludington | 52/15 |
| 2,905,114 | A | 9/1959 | Olson | |
| 3,280,524 | A | 10/1966 | Hull | |
| 3,717,968 | A | 2/1973 | Olsen et al. | |
| 3,742,668 | A | 7/1973 | Oliver | |
| 3,969,850 | A | 7/1976 | Hirai | |
| 4,005,557 | A | 2/1977 | Kramer et al. | |
| 4,233,786 | A * | 11/1980 | Hildreth | 52/94 |
| 4,461,129 | A | 7/1984 | von Platen | |
| 4,830,315 | A * | 5/1989 | Presz et al. | 244/200 |
| 5,050,489 | A | 9/1991 | Mankowski | |

(Continued)

FOREIGN PATENT DOCUMENTS

| | | |
|---|---|---|
| JP | 2-49805 | 2/1990 |

(Continued)

OTHER PUBLICATIONS

U.S. Appl. No. 11/236,394, filed Sep. 24, 2005, including Amendment, Drawings, Abstract, Claims, and Specification.

(Continued)

*Primary Examiner*—Jeanette E Chapman
*Assistant Examiner*—Daniel Kenny
(74) *Attorney, Agent, or Firm*—Finnegan, Henderson, Farabow, Garrett & Dunner, LLP

(57) ABSTRACT

An assembly attached to the roof perimeter to mitigate wind-generated vortices and uplift loads on the roof perimeter area of a building, applicable for both new constructions and retrofits of existing buildings. The assembly comprises an overhung screen portion preferably having face perforation and outer edge serration for equalizing pressure and disorganizing shear layer vorticity, and thus disrupting vortex formation. A roof edge windscreen is generally mounted onto an existing fascia or bargeboard. As an option appropriate for new constructions, it can also be mounted directly onto a framing member in place of fascia or bargeboard.

56 Claims, 6 Drawing Sheets

U.S. PATENT DOCUMENTS

| | | | | |
|---|---|---|---|---|
| 5,414,965 | A | 5/1995 | Kelley et al. | |
| D361,138 | S | 8/1995 | Moore et al. | |
| 5,813,179 | A | 9/1998 | Koenig, Jr. et al. | |
| 5,918,423 | A | 7/1999 | Ponder | |
| 6,044,601 | A | 4/2000 | Chmela et al. | |
| 6,128,865 | A * | 10/2000 | Din | 52/94 |
| 6,212,836 | B1 | 4/2001 | Larson | |
| 6,360,504 | B1 | 3/2002 | Webb et al. | |
| 6,539,675 | B1 | 4/2003 | Gild | |
| 6,601,348 | B2 * | 8/2003 | Banks et al. | 52/25 |
| 6,606,828 | B1 | 8/2003 | Lin et al. | |
| 6,786,015 | B2 | 9/2004 | Wilt | |
| 7,137,224 | B2 | 11/2006 | Rasmussen et al. | |
| 7,451,571 | B2 | 11/2008 | Allen | |
| 7,451,572 | B1 | 11/2008 | Inzeo et al. | |
| 7,487,618 | B2 | 2/2009 | Lin | |
| 2002/0124485 | A1 * | 9/2002 | Pulte | 52/96 |
| 2005/0210759 | A1 | 9/2005 | Austin et al. | |
| 2006/0248810 | A1 | 11/2006 | Ewing | |
| 2007/0113489 | A1 | 5/2007 | Kaiser et al. | |

FOREIGN PATENT DOCUMENTS

| | | |
|---|---|---|
| JP | 5-133141 | 5/1993 |
| JP | 6-185243 | 7/1994 |
| JP | 6-185244 | 7/1994 |
| JP | 6-288019 | 10/1994 |
| JP | 6-288050 | 10/1994 |
| JP | 6-288120 | 10/1994 |
| JP | 6-307122 | 11/1994 |
| JP | 6-336860 | 12/1994 |
| JP | 7-158318 | 6/1995 |
| JP | 8-49448 | 2/1996 |
| JP | 8-218683 | 8/1996 |
| JP | 2000-8326 | 1/2000 |

OTHER PUBLICATIONS

U.S. Appl. No. 11/098,330, filed Apr. 4, 2005, including Prel. Amendment, Drawings, Abstract, Claims, Specification, Examiner's search strategy and results, Search Information including classification, databases and other search related notes, Bibliographic Data Sheet, Non-Final Rejection, Amendment—After Non-Final Rejection.

U.S. Appl. No. 11/286,855, filed Nov. 26, 2005, including Prel. Amendment, Drawings, Abstract, Claims, Specification, Examiner's search strategy and results, Search Information including classification, databases and other search related notes, Non-Final Rejection, Amendment—After Non-Final Rejection.

Taher, Rima; Design of Low-Rise Buildings for Extreme Wind Events; Journal of Architectural Engineering, Mar. 2007, pp. 54-62.

Moreau, Sophie; "Caractérisation et developpements aérodynamiques de l'éspace intermédiaire en climat tropical humide : Conception d'une architecture de confort adaptée à la contrainte cyclonique." Thése de Doctorat, Univ. de Nantes/Ecole d'Architecture de Nantes (Doctoral thesis, Nantes Univ./School of Architecture of Nantes, france) (1999) pp. 1-294.

U.S. Appl. No. 12/320,867, filed Feb. 6, 2009: specification and abstract (11 pages), drawings (4 pages), and Preliminary Amendment filed Feb. 6, 2009 (11 pages).

U.S. Appl. No. 11/236,394, filed Sep. 24, 2005: Office Action dated Dec. 10, 2008 (7 pages), Amendment filed Apr. 10, 2009 (20 pages).

U.S. Appl. No. 11/286,855, filed Nov. 26, 2005: Final Office Action dated Sep. 16, 2008 (9 pages), Amendment After Final filed Jan. 23, 2009 (14 pages), Response filed Apr. 30, 2009 (14 pages).

U.S. Appl. No. 11/236,394, filed Sep. 24, 2005: Office Action dated Sep. 8, 2008 (5 pages), Response filed Oct. 8, 2008 (10 pages).

U.S. Appl. No. 11/286,855, filed Nov. 26, 2005: Interview Summary dated Dec. 22, 2008 (2 pages), Office Action dated Apr. 1, 2009 (4 pages).

* cited by examiner

ROOF EDGE WINDSCREEN

CROSS-REFERENCE TO RELATED APPLICATIONS

This application is entitled to the benefit of Provisional Patent Application Ser. No. 60/591,164, filed 2004 Jul. 26.

SEQUENCE LISTING

Non-Applicable.

BACKGROUND

1. Field of Invention

This invention relates to an aerodynamic means that mitigate wind generated vortices and uplift loads on the roof perimeter area of a building, in a simple, effective, and economical way, applicable for both new constructions and retrofits of existing buildings.

2. Discussion of Prior Art

The previous and present roof construction practices normally lead to a roof perimeter configuration that tends to generate corner-edge vortex and subjects the roof perimeter area to severe uplift and high risk of wind damage. Structural methods have been used to mitigate the risk of wind damage. For example, builders may use stronger fasteners or smaller spacing between fasteners for roof cover and deck in the roof edge and corner area, and use "hurricane straps" in lieu of toenails to tie down the roof framing to the wall structure. Some aerodynamic methods have been recommended. Banks et. al. described in U.S. Pat. No. 6,601,348 (2003) various types of wind spoilers raised above the roof plane that function to mitigate edge vortex formation. However, the apparatus is rather complicated in shape and structure, and is susceptible to wind damage itself because the raised structure subjects itself to accelerated airflow across the roof edge. In U.S. Pat. No. 4,005,557 (1977), Kramer et. al. described conceptual designs for a roof wind spoiler system used strictly near roof corners. The limited breadth of the apparatus impedes its effectiveness and causes higher wind loads along the neighboring segments of roof perimeter, which the apparatus does not extend to. Its design is also only suitable for flat roofs. Ponder disclosed in U.S. Pat. No. 5,918,423 (1999) a wind spoiler ridge cap that is designed for protecting roof ridges, while this present invention deals primarily with roof perimeters. The structure disclosed herein is continuous along a roof edge or at least substantially extends from the roof corners towards the middle part of a roof edge. The designs are suitable for both sloped and flat roofs. The examples given hereafter are particularly suitable for roofs that have roof cover extending outwardly beyond the roof deck boundary and subjecting itself to accelerated upward flow deflected by the wall directly below.

In U.S. Pat. No. 6,606,828 of this applicant et al., a series of roof edge configurations are recommended for use to mitigate vortex and high uplift in flat-roof perimeter areas, where the concept is one of coordinated exterior curvature design for a roof edge system. The present invention discloses a distinct roof edge apparatus that utilizes overhung plates that preferably have face perforation and/or outer edge serration.

SUMMARY OF THE INVENTION

This invention discloses an aerodynamic means that mitigate wind generated vortices and uplift loads on the roof perimeter area of a building, in a simple, effective, and economical way, applicable for both new constructions and retrofits of existing buildings. This is achieved by using an elongated device generally having an angle-like cross-section and being attached along a roof edge. The elongated device, which can be formed from sheet materials, is generally positioned in such a way that the open side of the angle faces outwardly and downwardly, with one side of the angle generally vertical and the other side generally horizontal. The generally vertical side is normally attached to an existing fascia or bargeboard, while the generally horizontal side extends and overhangs outwardly. The overhung portion is preferably made air-permeable and/or has a zigzag outer edge. The permeability provides a pressure equalizing effect while the outer edge serration provides a flow disorganizing effect, each of which prevents or interrupts the vortex from formation along a roof perimeter. Such a roof edge device is generally referred to as roof edge windscreen in this application. The specific configurations recommended herein pertinent to this invention are primarily applicable for edges of gable, hip, gambrel, mono-slope and flat roofs where no perimeter draining device, such as gutter, or edge flashing is installed. It is prudent that modifications be made according to the spirit and principles of the present invention when other types of roofs or roof edge constructions are encountered.

OBJECTS AND ADVANTAGES

Accordingly, several objects and advantages of the present invention are:

to provide roof edge devices which shield roof edge details from upward airflow, wind-driven rain and wind pressure;

to provide roof edge devices which suppress edge vortex formation and reduce wind loads on roofing materials, roof decks and framing in the roof perimeter areas;

to provide roof edge devices which reduce wind uplift loads generally on a building structure that are transferred from the roof;

to provide roof edge devices which reduce vortex scouring of roofing materials, such as asphalt shingles, roofing tiles, paver etc, and prevent them from becoming wind-borne missiles injuring people and damaging adjacent building envelopes during severe wind events;

to provide roof edge devices which stabilize wind flow over the roof and minimize cyclic loads on roof components resulting from recurring winds, reducing the chances of damage due to material fatigue;

to provide roof edge devices which prevent rainwater from being driven sideward and upward by wind turbulence and pressed through the gaps between roofing material and roof deck, and into the inner space of the roof assembly, during wind/rain events;

to provide roof edge devices which possess the desired aerodynamic performance while maintaining an aesthetic and waterproofing functionality under both extreme and recurring weather conditions.

Further objects or advantages are to provide roof edge devices which protect a roof edge from wind and rain damage, and which are still among the simplest, most effective and reliable, and inexpensive to manufacture and convenient to install. These and still further objects and advantages will become apparent from a consideration of the ensuing description and drawings.

DESCRIPTION OF THE PREFERRED EMBODIMENTS

Figure 1A:
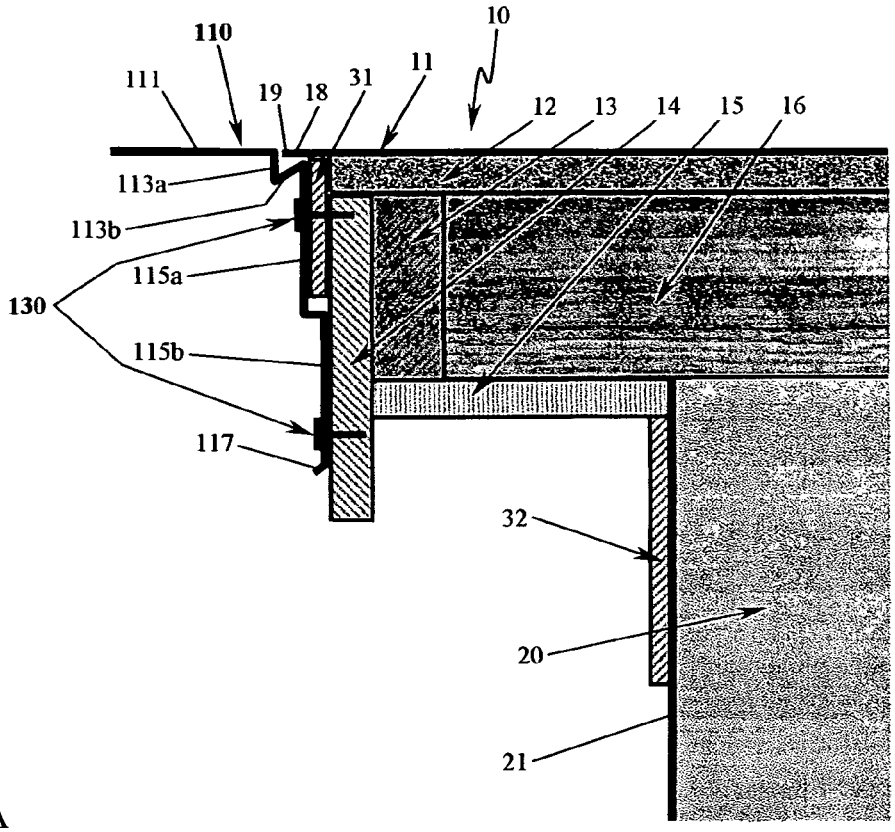
FIG. 1A schematically illustrates the cross-sectional view of one of the preferred basic configurations formed with sheet material, as being installed on an overhung gable end of a roof as an example.
Figure 1B:
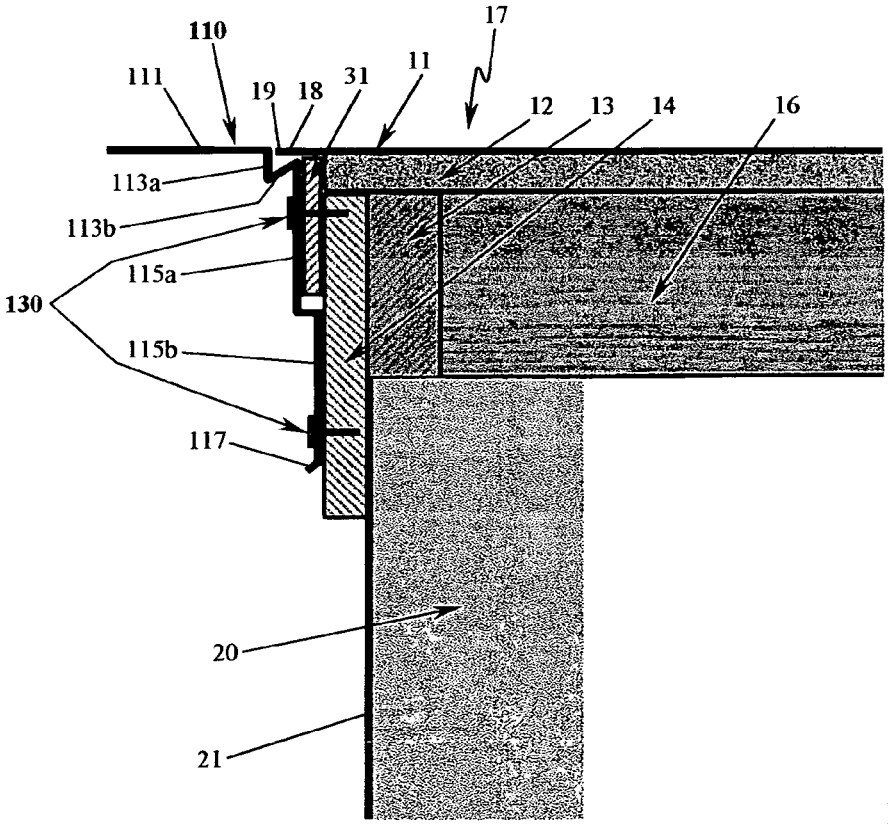
FIG. 1B shows a similar configuration as being installed on a non-overhung gable roof edge as an example.

A roof edge windscreen is generally an elongated assembly that is disposed longitudinally in parallel with, and attached to, a roof edge. FIG. 1A shows a cross-section view for one of the preferred configurations of the present invention, a roof edge windscreen 110 being installed on a gable-end overhang 10 of a roof structure. A typical roof overhang is a portion of a roof structure that extends substantially outwards beyond the outer surface 21 of a supporting wall 20 of a building. The gable-end overhang 10, along with such associated components as roof covering 11, deck 12, rafter 13, fascia board 14, soffit board 15, lateral framing member 16, and aesthetic trim members 31 and 32, are prior arts. They are included here merely for illustration of their relationships with the roof edge windscreen 110 that is the subject matter of this invention. The apparatus can also be used for non-overhung roof perimeters, for example, on a non-overhung gable-end 17 as depicted in FIG. 1B. Moreover, although many of the embodiments in this application are exemplified with gable edges, the present invention is applicable on other types of roof edges. Specific examples include, but not limited to, gable, hip, gambrel, mono-slope, and flat roof edges. For roof edges where certain rainwater runoff is expected, such as the eave edges of gable and hip roofs, this invention is also applicable where roof edge windscreens will replace rainwater-draining devices such as gutters as described later in this application.

Figure 1C:
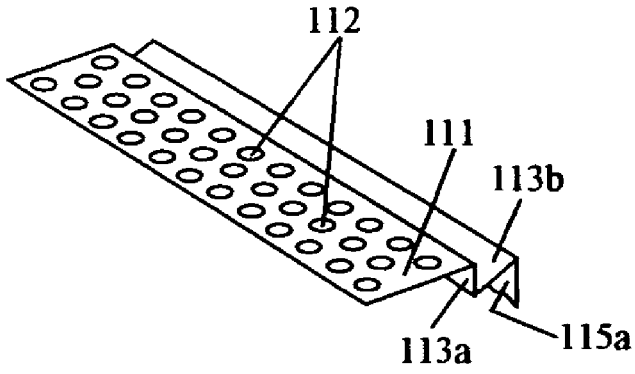
FIGS. 1C and 1D are isometric views showing examples of face perforation and edge serration.
Figure 1D:
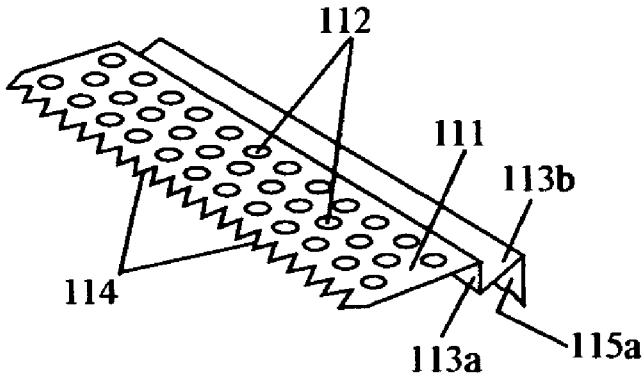

The roof edge windscreen 110, exemplified here as made of sheet material, consists of a screen portion 111, an intermediate channel portion formed by segments 113*a* and 113*b*, and lower mounting portions 115*a* and 115*b*, along with an optional drip edge 117, adjoining consecutively. As exemplified in FIGS. 1C and 1D, the screen portion 111 preferably has face perforation 112 (FIG. 1C) or outer edge serration 114, or has both (FIG. 1D).

Herein the perforation 112 is made with a plurality of through-holes on the sheet material. The specific layout, number, shapes and sizes of the distributed through-holes are not of primary significance, as long as the overall porosity resulting from the face perforation is in a preferred range approximately between 25% and 75% to provide desired air-permeability. This helps equalizing pressures on the opposite sides of the screen and suppresses the forcing mechanism for vortex formation along the edge. In FIG. 1D, in addition to perforation, edge serration is made with a zigzag or wavy outer edge of the screen portion 111, which disorganizes the flow shear layer over the edge and prevents vorticity embedded in the shear layer from forming a concentrated vortex. While larger sizes are preferred for the projections and notches to provide deeper serration or indentation, their specific layout, number and shapes are not of critical significance. Square, semi-circular and semi-elliptic shapes etc., for example, in addition to the triangular shape shown herein, are all permissible without compromising the functionality described herein. It is also allowable that the perforations, projections and notches have varying shapes and sizes in the same assembly. The choices may be made in combination with aesthetic considerations.

Figure 2:
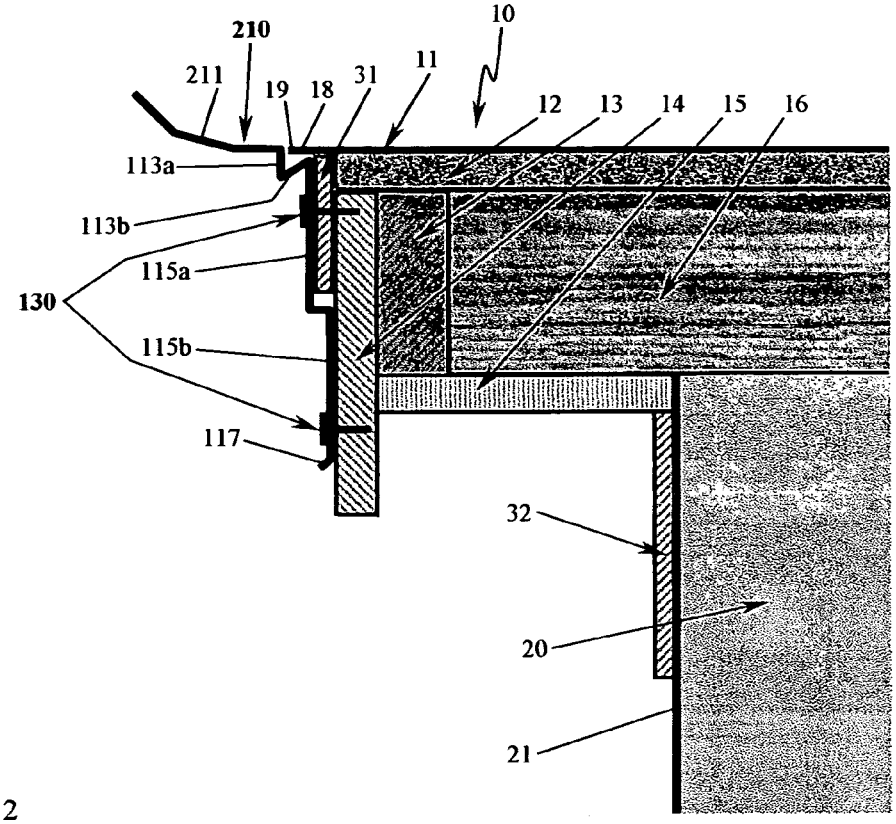
FIGS. 2 and 3 schematically illustrate alternative cross-sectional shapes for the screen portion of the roof edge windscreen.
Figure 3:
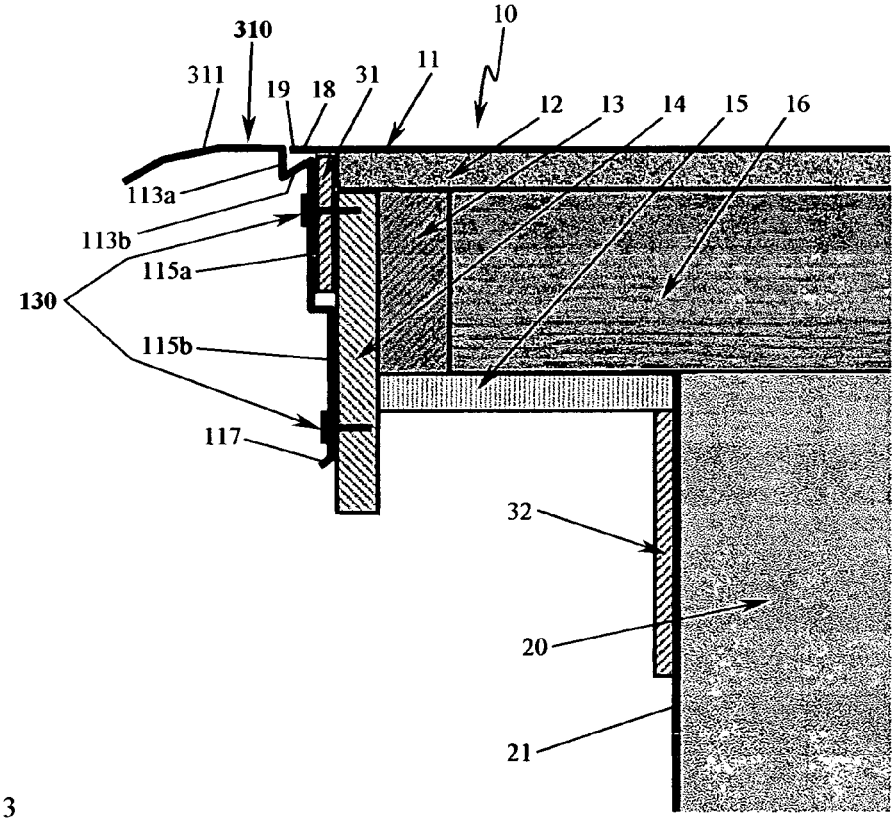
Figure 7:
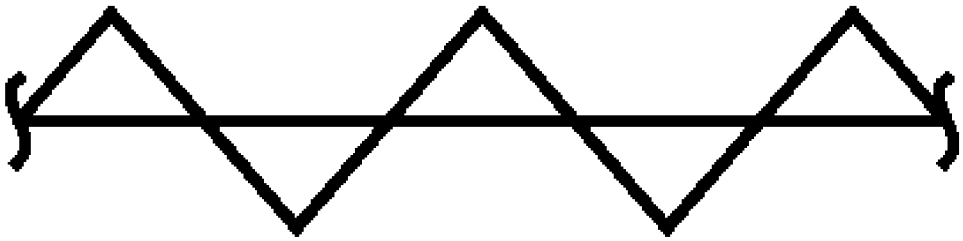
FIG. 7 illustrates an optional serrated edge configuration where the sawtooth-like elements or projections bend alternatively upwardly and downwardly.

Thus the function of face perforation and edge serration is to disrupt the formation of the roof edge vortex that would otherwise cause severe uplift loads and scouring on the roof surface.As illustrated in FIGS. lA and 1B, the screen portion 111 is disposed with its inner side in close proximity to the outer edge 19 of the roof covering 11 and is extended generally outwardly. Various modifications to the configuration of the screen portion 111 shown in FIGS. lA and 1B are permissible. For example, as illustrated in FIG. 2, the screen portion 211, or its outer segment, may curve outwardly and upwardly for roof edges where no significant rainwater runoff is expected, to the extent that such configurations are not expected to cause debris clogging and accumulation along the roof edge. As illustrated in FIG. 3, the screen portion 311, or its outer segment, may also curve outwardly and downwardly. Furthermore, as an option for serrated edge configuration, the sawtooth-like elements or projections can bend alternatively upwardly and downwardly, see FIG. 7. These alternatives may be considered in conjunction with the aesthetic aspect of a building.

The intermediate channel portion is formed by a generally vertical segment 113*a* and a generally inward and upward extending segment 113*b* that adjoin the screen portion 111 and the mounting portion 115*a* respectively, as illustrated in each of the preceding figures. The channel portion formed by segments 113*a* and 113*b* serves as both a draining device and a protection from upward flow and pressure for the underside of the overhung portion 18 of the roof covering 11. Optional draining holes (not shown) can be used near the lower edge of the channel portion where segments 113*a* and 113*b* meet.

The roof edge windscreen 110 may be mounted on and secured to a roof edge with any appropriate means that does not negatively affect the functionality of the screen portion 111 or that of the intermediate channel portion formed by 113*a* and 113*b* described herein. A simple example is already illustrated in the preceding figures, i.e. FIGS. 1, 2 and 3. The mounting portions 115*a* and 115*b* are collectively conformed to the existing configuration of the roof edge and are attached to the side of the roof edge using fasteners 130. Adequate aesthetic finishes and watertight sealing on the fasteners may be desired. Optional space washers (not shown) can also be placed between a mounting plate portion 115*a*, or 115*b*, and the trim member 31, or fascia board 14, at the location where a fastener is placed, to maintain a small gap for venting out moisture residing therein. In fact, any suitable mechanisms of similar functions may be used for mounting and securing the roof edge windscreen 110 onto a roof edge. The drip edge 117 is also optional.

The roof edge windscreen has at least three functions. The first is to suppress vortex over a roof edge. High uplifts and strong scouring that result from wind-induced edge vortex above the roof, are prime causes for wind damage to roof components. Secondly, it shields the underside of the protruding portion 18 of the roof covering 11, such as an array of asphalt shingles or wood shakes, from upward flow and pressure that tend to peel the roof covering 11 upwards and away from other parts of the roof edge assembly 10. The third function is to prevent upward flow-driven rain from being pressured into the roof structure through the unsealed gaps between the roof covering 11 and the roof components beneath it.

Figure 4:
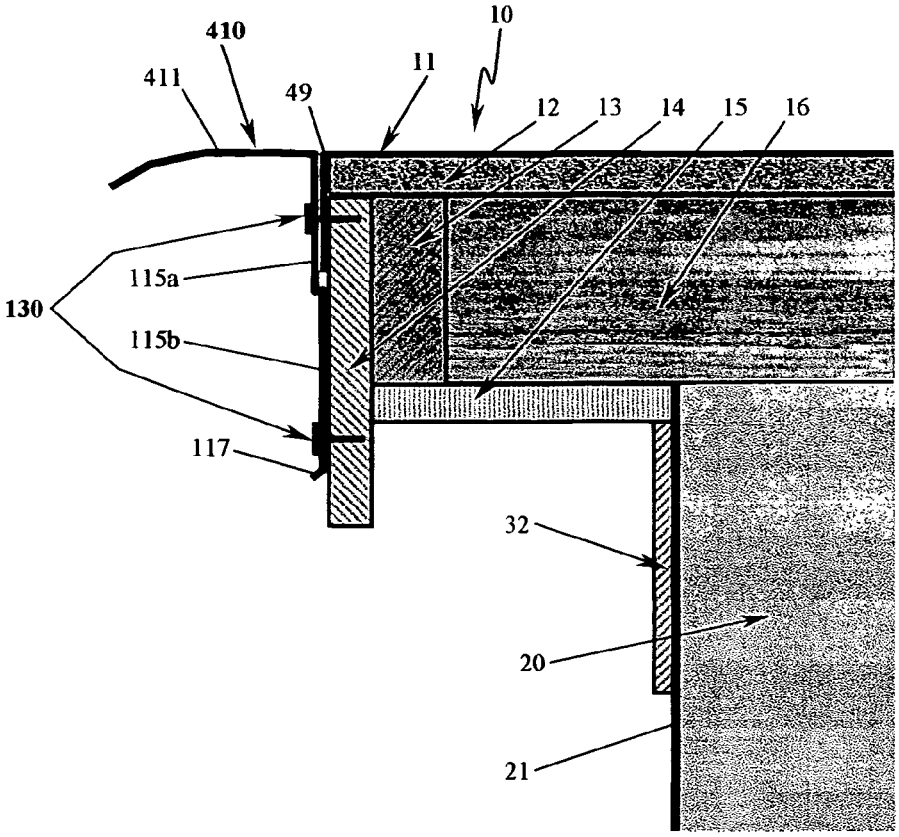
FIG. 4 exemplifies a configuration for roof edges with wrapped-down roof covering.

FIG. 4 provides an example for a modified roof edge windscreen 410 being installed on a roof edge where the roof covering 49 wraps downwards, most often seen with metal roof coverings, such as metal tiles, metal shakes and metal panels, as well as clay tiles in some instances.

Figure 5:
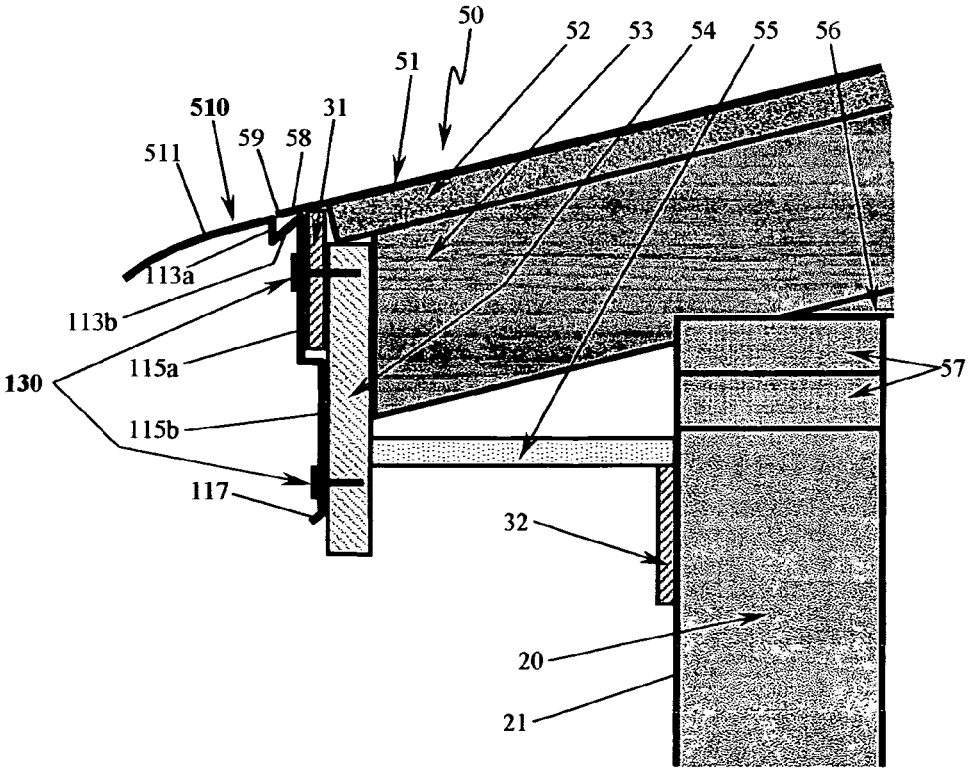
FIG. 5 illustrates an example of configurations for eave edges where significant rainwater run-off is expected.

FIG. 5 illustrates a roof edge windscreen 510 being used on an eave edge of a sloped roof where a draining device such as a gutter system is not being used. An outwardly and downwardly extending screen portion 511 is preferred to allow rainwater to shed off the eave, and drain partly through the distributed perforation and partly off the outer edge of the roof edge windscreen 510. This is in fact a better draining scheme than allowing roof rainwater cascade down directly from the eave edge, which erodes sods, soils or aggregates around a building perimeter.

Figure 6:
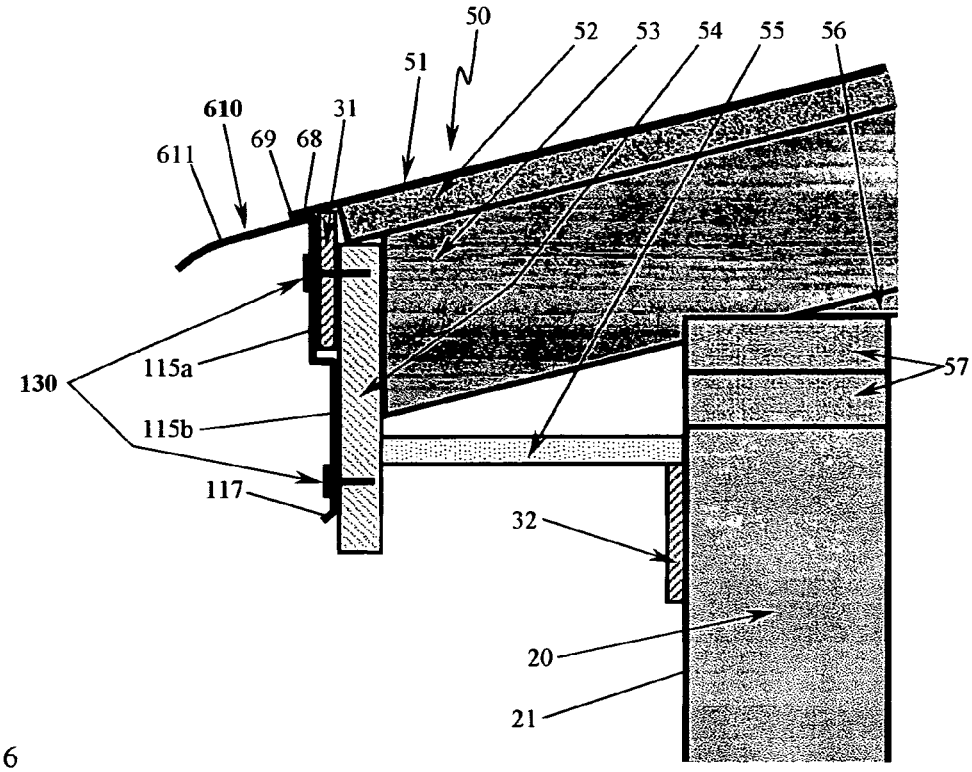
FIG. 6 illustrates an alternative example of configurations for eave edges where significant rainwater run-off is expected.

FIG. 6 shows an alternative, simpler configuration of roof edge windscreen 610 being used on an eave edge of a sloped roof where a draining device such as a gutter system is not being used. Herein the screen portion 611 extends inwardly, closely below the outmost portion of the roof cover 68. This configuration has similar functions to the one depicted in FIG. 5.

A roof edge windscreen provides protection against wind and rain damage for a broad variety of roof constructions whenever the apparatus and its geometric relationship with the roof perimeter are configured in accordance with the spirit of this invention, as exemplified herein in the specification and governed in the appended claims.

Installation and Operation

An embodiment of this invention is a passive flow control device for roof edges. Once installed properly, it stays functioning in such a way that it mitigates vortex formation at a roof edge and reduces uplifts and vortex scouring on the roof perimeter area, whenever the wind blows towards a building bearing atop such roof edge devices, and requires no active operational intervention.

CONCLUSION, RAMIFICATIONS, AND SCOPE

It is apparent that roof edge windscreens of this invention provide advantageous devices for mitigating roof edge vortex and roof uplift, and are still among the simplest, most effective and reliable, inexpensive to manufacture and convenient to install.

Although the description above contains many specifications, these should not be construed as limiting the scope of the invention but as merely providing illustrations of some of the presently preferred embodiments of this invention. Various changes, modifications, variations can be made therein without departing from the spirit of the invention. Roof edge windscreens can be made of any reasonably durable material with any appropriate means of fabrication as long as a configuration according to the spirit of this invention is accomplished to support the described working mechanism and to provide the associated functionality. Various surface portions of a roof edge windscreen may also bear such surface details as corrugation or steps of adequate sizes, as opposed to perfectly smooth surfaces. Any appropriate conventional or new mounting method can be used to secure a roof edge windscreen to a roof perimeter without departing from the spirit of this invention. Thus the scope of the invention should be determined by the appended claims and their legal equivalents, rather than by the examples given.

What I claim as my invention is:

1. An assembly attached to a perimeter of a roof, said assembly comprising:

a generally elongated member disposed along the roof perimeter, the generally elongated member including
an overhung screen portion,
an intermediate channel portion, and
a mounting plate portion securing said elongated member to said roof perimeter, wherein said overhung screen portion is substantially planar, wherein said overhung screen portion has an inner side in close proximity with an outermost edge of said roof perimeter, wherein said overhung screen portion extends generally outwardly away from said roof perimeter, wherein said intermediate channel portion adjoins said inner side of said overhung screen portion, wherein said intermediate channel portion extends generally downwardly and bends back upwardly and inwardly to form an upwardly-open channel below said outermost edge of said roof perimeter, wherein said mounting plate portion adjoins said intermediate channel portion, wherein said mounting plate portion extends generally downwardly from said intermediate channel portion, and wherein said mounting plate portion generally conforms to an outer face of said roof perimeter.

2. The assembly of claim 1, wherein said overhung screen portion has face perforations.

3. The assembly of claim 1, wherein said overhung screen portion has face perforations, said perforations having uniform or varying shapes and sizes.

4. The assembly of claim 1, wherein said overhung screen portion has an outer edge serration.

5. The assembly of claim 1, wherein said overhung screen portion has an outer edge serration including projections and notches having varying shapes and sizes, said projections bending at least one of upwardly and downwardly.

6. The assembly of claim 1, wherein said overhung screen portion has face perforations and an outer edge serration.

7. The assembly of claim 1, wherein said inner side of said overhung screen portion is in close spaced proximity with the outermost edge of said roof perimeter.

8. The assembly of claim 1, wherein said overhung screen portion is substantially planar in its entirety.

9. The assembly of claim 8, wherein an uppermost surface of the roof defines a plane, and wherein said overhung screen portion is substantially coplanar with the plane defined by the uppermost surface of the roof.

10. The assembly of claim 8, wherein an uppermost surface of the roof is generally flat, and wherein said overhung screen portion is generally horizontal.

11. The assembly of claim 1, wherein the roof includes a roof covering defining an uppermost surface of the roof, and wherein the inner side of the overhung screen portion and an outer edge of the roof covering are spaced apart from one another and define an open space positioned vertically above the upwardly-open channel of the intermediate channel portion such that the upwardly-open channel is exposed.

12. The assembly of claim 11, wherein the roof covering includes a protruding portion extending outwardly beyond a boundary of a roof deck positioned under the roof covering, the protruding portion including the outer edge of the roof covering.

13. The assembly of claim 1, wherein the overhung screen portion has a porosity greater than 50% and less than 75%.

14. The assembly of claim 1, wherein the generally elongated member extends along the roof perimeter continuously from one corner of the roof to another corner of the roof.

15. The assembly of claim 1, wherein the generally elongated member extends along the roof perimeter at least substantially from one corner of the roof toward a middle part of the roof perimeter.

16. An assembly for attachment to a perimeter of a roof, said assembly comprising:

an elongated member including an overhung screen portion, a mounting plate portion, and an intermediate channel portion arranged between said overhung screen portion and said mounting plate portion, wherein said overhung screen portion is substantially planar, wherein said overhung screen portion is configured to extend generally laterally outwardly away from said roof perimeter to a free end of said overhung screen portion, wherein said overhung screen portion includes a second end opposite from said free end, wherein said second end of said overhung screen portion is configured to be arranged in close proximity with an outermost edge of said roof perimeter, wherein said mounting plate portion adjoins said intermediate channel portion;

wherein said mounting plate portion extends substantially downwardly away from said second end of said overhung screen portion, wherein said mounting plate portion is configured to be arranged in general conformance to an outer face of said roof perimeter, and wherein said assembly is configured to suppress wind-generated vortices in the vicinity of said roof perimeter.

17. The assembly of claim 16, wherein said overhung screen portion is arranged substantially perpendicular with respect to said mounting plate portion.

18. The assembly of claim 16, wherein the intermediate channel portion extends generally downwardly from said overhung screen portion and bends back upwardly and inwardly to form a channel.

19. The assembly of claim 16, wherein said overhung screen portion includes a plurality of through-holes.

20. The assembly of claim 19, wherein said plurality of through-holes are substantially uniform in size and shape.

21. The assembly of claim 16, wherein said free end of said overhung screen portion includes a serration formed by a series of projections and notches.

22. The assembly of claim 21, wherein the series of projections of said overhung screen portion are substantially uniform in size and shape.

23. The assembly of claim 21, wherein at least one of the projections is bent upwardly or downwardly.

24. The assembly of claim 23, wherein the series of projections are bent alternately upwardly and downwardly.

25. The assembly of claim 16, wherein said overhung screen portion includes a plurality of through-holes and includes an outer edge defined by a serration formed by a series of projections and notches.

26. The assembly of claim 16, wherein said mounting plate portion is configured to be secured to the outer face of said roof perimeter.

27. The assembly of claim 26, wherein said mounting plate portion includes at least one mounting hole for a fastener.

28. The assembly of claim 16, wherein said overhung screen portion is substantially planar from said free end to said second end of said overhung screen portion opposite from said free end.

29. The assembly of claim 28, wherein said second end of said overhung screen portion directly adjoins said intermediate channel portion and an upper end of said mounting plate portion directly adjoins said intermediate channel portion.

30. The assembly of claim 29, wherein the intermediate channel portion extends generally downwardly from said second end of said overhung screen portion and bends back upwardly and inwardly to form a channel.

31. The assembly of claim 28, wherein said overhung screen portion includes a plurality of through-holes.

32. The assembly of claim 28, wherein said free end of said overhung screen portion includes a serration formed by a series of projections and notches.

33. The assembly of claim 16, wherein said overhung screen portion is configured to extend outwardly and downwardly from said second end of said overhung screen portion to said free end of said overhung screen portion.

34. The assembly of claim 18, wherein said overhung screen portion defines a first length from said free end of said overhung screen portion to said second end of said overhung screen portion, and said intermediate channel portion defines a second length between said second end of said overhung screen portion and an upper end of said mounting plate portion, wherein said first length is greater than said second length.

35. The assembly of claim 29, wherein said overhung screen portion defines a first length from said free end of said overhung screen portion to said second end of said overhung screen portion, and said intermediate channel portion defines a second length between said second end of said overhung screen portion and said upper end of said mounting plate portion, wherein said first length is greater than said second length.

36. The assembly of claim 16, wherein said second end of said overhung screen portion is configured to be arranged in close spaced proximity with the outermost edge of said roof perimeter.

37. The assembly of claim 16, wherein the assembly is configured such that the second end of the overhung screen portion and an outer edge of a roof covering of the roof are spaced apart from one another and define an open space positioned vertically above the intermediate channel portion such that the intermediate channel portion is exposed.

38. The assembly of claim 16, wherein the overhung screen portion has a porosity greater than 50% and less than 75%.

39. The assembly of claim 16, wherein the elongated member is configured to extend along the roof perimeter continuously from one corner of the roof to another corner of the roof.

40. The assembly of claim 16, wherein the elongated member is configured to extend along the roof perimeter at least substantially from one corner of the roof toward a middle part of the roof perimeter.

41. An assembly attached to a perimeter of a roof, said assembly comprising:

an elongated member including an overhung screen portion, a mounting plate portion, and an intermediate channel portion arranged between said overhung screen portion and said mounting plate portion, wherein said overhung screen portion is substantially planar, wherein said overhung screen portion extends generally laterally outwardly away from said roof perimeter to a free end of said overhung screen portion, wherein said overhung screen portion includes a second end opposite from said free end, wherein said second end of said overhung screen portion is arranged in close proximity with an outermost edge of said roof perimeter, wherein said mounting plate portion adjoins said intermediate channel portion, wherein said mounting plate portion extends substantially perpendicular to said overhung screen portion, wherein said mounting plate portion extends substantially downwardly and away from said second end of said overhung screen portion, wherein said mounting plate portion generally conforms to an outer face of said roof perimeter, and wherein said assembly is configured to suppress wind-generated vortices in the vicinity of said roof perimeter.

42. The assembly of claim 41, wherein said second end of said overhung screen portion is positioned at substantially the same height as the outermost edge of said roof perimeter.

43. The assembly of claim 41, wherein said overhung screen portion includes a plurality of through-holes.

44. The assembly of claim 41, wherein said free end of said overhung screen portion includes a serration formed by a series of projections and notches.

45. The assembly of claim 44, wherein the series of projections of said overhung screen portion are substantially uniform in size and shape.

46. The assembly of claim 43, wherein said free end of said overhung screen portion includes a serration formed by a series of projections and notches.

47. The assembly of claim 41, wherein said overhung screen portion and said mounting plate portion form a one-piece, integral elongated member.

48. The assembly of claim 41, wherein said second end of said overhung screen portion is arranged in close spaced proximity with the outermost edge of said roof perimeter.

49. The assembly of claim 41, wherein said overhung screen portion is substantially planar from said free end to said second end opposite said free end.

50. The assembly of claim 49, wherein an uppermost surface of the roof defines a plane, and wherein said overhung screen portion is substantially coplanar with the plane defined by the uppermost surface of the roof.

51. The assembly of claim 49, wherein an uppermost surface of the roof is generally flat, and wherein said overhung screen portion is generally horizontal.

52. The assembly of claim 41, wherein the roof includes a roof covering defining an uppermost surface of the roof, and wherein the second end of the overhung screen portion and an outer edge of the roof covering are spaced apart from one another and define an open space positioned vertically above the intermediate channel portion such that the intermediate channel portion is exposed.

53. The assembly of claim 52, wherein the roof covering includes a protruding portion extending outwardly beyond a boundary of a roof deck positioned under the roof covering, the protruding portion including the outer edge of the roof covering.

54. The assembly of claim 41, wherein the overhung screen portion has a porosity greater than 50% and less than 75%.

55. The assembly of claim 41, wherein the elongated member extends along the roof perimeter continuously from one corner of the roof to another corner of the roof.

56. The assembly of claim 41, wherein the elongated member extends along the roof perimeter at least substantially from one corner of the roof toward a middle part of the roof perimeter.

* * * * *